United States Patent [19]

Schoenfield

[11] 4,163,343

[45] Aug. 7, 1979

[54] EDUCATIONAL TOY AND AMUSEMENT DEVICE

[76] Inventor: Connie Schoenfield, P.O. Box 661, Beverly Hills, Calif. 90210

[21] Appl. No.: 899,722

[22] Filed: Apr. 25, 1978

[51] Int. Cl.[2] ..... A01C 1/04

[52] U.S. Cl. ..... 47/66; 428/16; 46/116; 47/1 R; 47/56; 47/14

[58] Field of Search ..... 46/116, 135 R, 1 R, 46/156–158, 164, 172; 47/56, 1, 14–15, 66, 84; 428/16

[56] References Cited

U.S. PATENT DOCUMENTS

| | | | |
|---|---|---|---|
| 2,233,032 | 2/1941 | Robinson | 47/66 |
| 2,431,063 | 11/1947 | McGahey | 47/14 |
| 3,080,681 | 3/1963 | Merrill et al. | 47/56 |
| 3,312,465 | 4/1967 | Braunhut | 46/116 X |
| 3,362,106 | 1/1968 | Goldring | 47/56 |
| 3,733,745 | 5/1973 | Ingerstedt et al. | 47/56 X |

*Primary Examiner*—Robert E. Bagwill

[57] ABSTRACT

A toy which can be used to instruct people and preferably children, on how to grow seeds and care for the same after they germinate as well as a device which can be used as a novelty item, such as a greeting card whose image will change upon the germination of the seed associated therewith.

5 Claims, 3 Drawing Figures

FIG.1
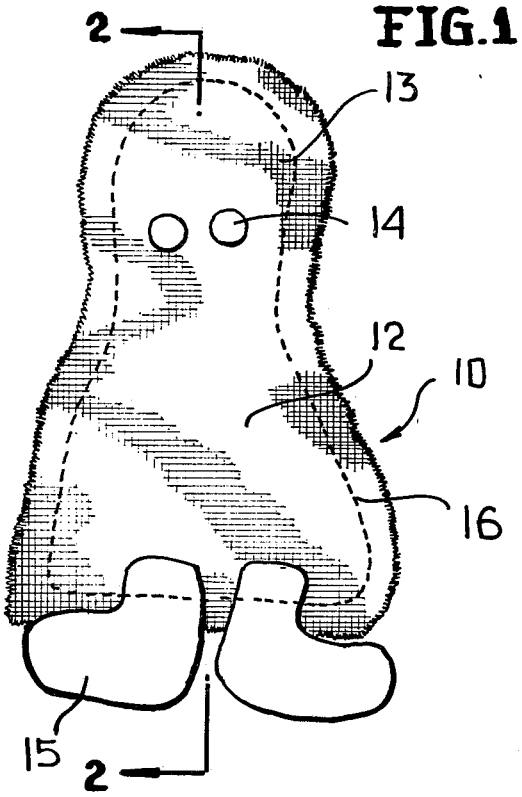
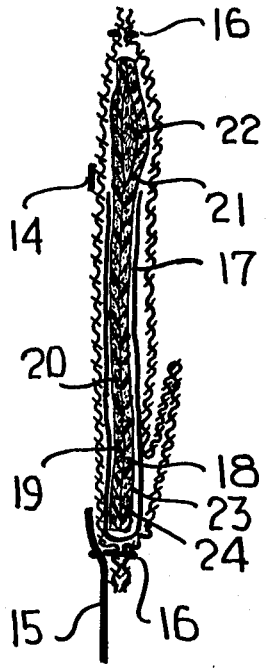
FIG.2
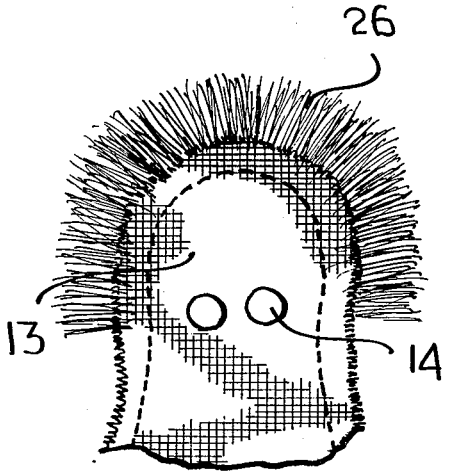
FIG.3

EDUCATIONAL TOY AND AMUSEMENT DEVICE

BACKGROUND OF THE INVENTION

Various devices have been fabricated to teach children the manner in which seed can be cared for, germinated and thereafter treated when the same become plants, and while these devices have been successful and hold a child's attention span, the same have the drawbacks of generally being complicated and involved.

BRIEF SUMMARY OF THE INVENTION

The present invention relates to a toy which serves a dual function of an educational device as well as a novel greeting card type, which can be used both to instruct children in the growth of plants and also as a novelty item by immersing the same in water to change its configuration. Simply stated, the toy is comprised of an exterior housing in the form of a porous cloth-type member which encases layers of sponge which in turn, are encased in a plastic bag-like member with seed disposed between the sponges anywhere desired so that upon germination, the same will push through the sponge and outwardly through the porous housing. In places where the seed is positioned, the plastic bag is removed to permit the seed to grown therethrough.

The plastic covering serves to retain the water within the sponges in order that the seed may have enough moisture to grow.

Additionally, the outer housing can be shaped to any desired design, such as a doll, car, airplane or the like.

DESCRIPTION OF THE DRAWING

FIG. 1 is a perspective view of a toy of the invention;

FIG. 2 is a cross-sectional view taken on the lines 2—2 of FIG. 1; and FIG. 3 is a close-up view showing the toy of FIG. 1 when the seed is germinated in the head portion.

DETAILED DESCRIPTION OF THE PREFERRED EMBODIMENT

Referring to FIG. 1, the toy of the present invention is depicted generally by the numeral 10 and is comprised of an outer porous cover 12, cut in the shape of a doll having a head 13, with eyes 14, and legs 15. While a doll-like member is shown, it is apparent that any such design can be utilized: with the prime consideration being that the outer covering 12 be made from porous material such as burlap or the like. Generally, two pieces of mating material are provided whereby the same can be stitched along its peripheral edges 16, to form an inner pocket within material can be placed.

As seen in FIG. 2, the pocket 17 formed by the aforementioned outer coverings provide a recess within which two layers of sponge 18, 19, are disposed and placed in contiguous relationship as at 20 over a major portion of their length except in the area of the head 13 wherein the same are separated to provide a recess 21, within which grass seed 22, or the like is disposed and maintained.

The sponge layers 18, 19 are, in turn, encased in thin plastic material 23, 24, 25, except in the areas where the seeds are positioned. This arrangement permits the toy to be placed or dunked in water whereby the sponge will absorb the same and be maintained therein by the presence of the plastic material 23, 24, 25. This moisture aids in the germination of the grass seed 22, which when the same sprouts, will provide a head covering in the form of hair-like members 26, as shown in FIG. 3 of the drawings.

What is claimed is:

1. A toy comprising an outer porous housing forming a pocket therein, fluid absorbing material disposed within said pocket, said fluid absorbing material being positioned to form a recess with respect to certain portions of the outer housing, seeds disposed in said recess, and plastic material encasing said fluid absorbing material in all areas except where said seeds are positioned.

2. The toy of claim 1 wherein the outer housing is comprised of porous material formed in cooperating blanks and stitched adjacent its peripheral edges to form said pocket.

3. The toy of claim 2 wherein the fluid absorbing material are sheets of sponge and are positioned within said pocket.

4. The toy of claim 3 wherein the cooperating blanks are shaped to form a doll and the seeds are positioned so that upon germination, the same will extend through the sponge and outwardly through the porous material to form hair for the doll.

5. The toy of claim 4 wherein the outer porous material is burlap.

* * * * *